US005602519A

United States Patent [19]

Kim

[11] Patent Number: 5,602,519

[45] Date of Patent: Feb. 11, 1997

[54] SYNCHRONOUS CABLE COUPLING DEVICE OF FLY BACK TRANSFORMER

[75] Inventor: Myung H. Kim, Kyongki-Do, Rep. of Korea

[73] Assignee: Samsung Electro-Mechanics Co., Ltd., Kyongki-do, Rep. of Korea

[21] Appl. No.: 581,686

[22] Filed: Dec. 29, 1995

[30] Foreign Application Priority Data

Dec. 30, 1994 [KR] Rep. of Korea ..... 1994-38985
Dec. 18, 1995 [KR] Rep. of Korea ..... 1995-51395

[51] Int. Cl.[6] ..... H01F 17/02; H01F 27/30

[52] U.S. Cl. ..... 336/96; 336/175; 336/223

[58] Field of Search ..... 336/90, 96, 174, 336/175, 178, 223

[56] References Cited

U.S. PATENT DOCUMENTS 3,725,741 4/1973 Misoncik ..... 336/175
4,746,891 5/1988 Zylstra ..... 336/175

FOREIGN PATENT DOCUMENTS 53-11928 1/1978 Japan .

*Primary Examiner*—Thomas J. Kozma
*Attorney, Agent, or Firm*—Lowe, Price, LeBlanc & Becker

[57] ABSTRACT

A coupling device of synchronous cable for connecting a frequency of an induced voltage generated from a fly back transformer (FBT) is provided. The coupling device includes a metal support 53 formed with an accommodating groove 52 so as to be interposed with a shield metal 51 to a front wall surface of a case 50 of the FBT. Case 50 is provided with a ferrite core 60, and the ferrite core 60 is inserted and supported between the metal support 53. Shield metal 51 of the metal support 53 is connected with a synchronous cable 70 and grounded so as to draw out an induced voltage of the FBT. According to this design, not only a frequency of the induced voltage generated from the FBT is made to be stably drawn out, but also the coupling of the synchronous cable is automated whereby its workability and a productivity are improved. In addition, the synchronous cable is coupled and fixed in a firm state, movement of the synchronous cable is prevented, and a frequency of the synchronous signal and an operating frequency of the FBT can be effectively stabilized.

7 Claims, 3 Drawing Sheets

SYNCHRONOUS CABLE COUPLING DEVICE OF FLY BACK TRANSFORMER

BACKGROUND OF THE INVENTION

The present invention generally relates to a coupling device for a synchronous cable that connects a frequency of an induced voltage generated from a fly back transformer (hereinafter called as 'FBT'). The FBT is a high voltage generating device for feeding a high voltage to a cathode-ray tube of a television (TV) or a monitor via the synchronous cable.

A synchronous cable coupling device of an FBT is made with a metal supporting means formed with an accommodating groove so as to be interposed with a shield metal toward a front wall surface of the FBT and engaged with a ferrite core. The ferrite core is interposed and supported between the metal supporting means, and the shield metal of the metal supporting means is connected with a synchronous cable and grounded so as to draw out an induced voltage of the FBT. As a result, a frequency of the induced voltage generated from the FBT is stably drawn out, and a coupling or connecting of the synchronous cable is automated whereby its workability and productivity are improved. In addition, moving of FBT ferrite core is prevented and simultaneously a radiation of electronic wave generated from an external gap of the ferrite core can be decreased.

In general, the synchronous cable connected and provided to the FBT transmits the frequency generated by the FBT by connecting the frequency of the induced voltage generated by the FBT to a set or device. The operating frequency of the FBT receives a power supply and a frequency of various operating signals.

In a related technique, as shown in FIG. 1, it is made by a structure such that at a state that high voltage and low voltage bobbins (not shown) being wound with coils are accommodated therein to be superposed to the interior of FBT case 10. An epoxy resin is filled and molded between hc high voltage and low voltage bobbins and the FBT case 10, and a "C"-shaped ferrite core 20 is inserted into the top and bottom of the FBT case 10 while maintaining a predetermined gap therebetween and then fixed. The FBT is thereby connected with a set such as a monitor and the like through a high voltage cable, whereby a high voltage is supposed thereto.

The FBT having a structure as described above generates a high voltage through the coils wound around the high voltage and low voltage bobbins, and the high voltage generated at this moment is supplied to the set such as a monitor and the like through an anode cable.

And, in accordance with the ferrite core 20 provided to the FBT as described above, in case of applying power to the FBT, an electronic wave is inevitably generated and radiated to internal surface and external surface gaps 21,22 between the top and bottom ferrite cores. The electronic wave of the internal surface gap 21 among the electronic waves generated from the internal and external surface gaps 21,22 of the ferrite core 20 is absorbed through the coils wound around the high voltage and low voltage bobbins in the interior of FBT case 10, and the external electronic wave generated from the external surface gap 22 of the ferrite core 20 is left as it is.

In a connecting method of a conventional FBT cable, as shown in FIG. 2, a predetermined length of a synchronous or continuous cable 30 is plaited to a side of the ferrite core 20 provided to the FBT case 10 by a thermo-shrinking tube 31 so as to be connected to a printed circuit board.

However, in the FBT as above, since the synchronous cable 30 is manually plaited using the thermo-shrinking tube 31 to a side of the ferrite core 20 provided to the PBT case 10, this manual process is cumbersome. In addition, since this process is made to the exterior of the cable one by one, defects have frequently arisen in case of the connecting work associated with the synchronous cable. In addition, the synchronous cable 30 plaited to the ferrite core 20 is easily moved whereby the frequency of voltage induced within the FBT becomes impossible to transmit in a stable manner. Accordingly, there have been many problems such that an electric property of the product that receives the voltage becomes deteriorated and so on as a result of the unstable voltage.

OBJECT AND SUMMARY OF THE INVENTION

Therefore, the present invention is directed to improve the conventional various problems described above, and it is an object of the present invention to provide a synchronous cable coupling device of a FBT in which not only a frequency of an induced voltage generated from a FBT is made to be stably drawn out, but also a coupling of the synchronous cable is automated. Another object of the invention is to provide a coupling device where its workability and productivity are improved, and the synchronous cable is coupled and fixed in a firm state. Accordingly, movement of the synchronous cable is prevented, and a frequency of the synchronous signal and an operating frequency of the FBT can be further effectively transmitted.

Another object of the present invention is to provided a synchronous cable coupling device of a FBT for preventing movement of a FBT ferrite core upon coupling the synchronous cable, and simultaneously capable of effectively reducing a radiation of an electronic wave generated from an external surface gap of the ferrite core through the synchronous cable.

As a technical method for attaining the above objects, in accordance with the present invention, a synchronous cable coupling device of FBT is provided in which a metal supporting means is formed with an accommodating groove. The accommodating groove is interposed with a shield metal to a front wall surface of a case of the FBT provided with a ferrite core. The ferrite core is inserted between the metal supporting means, and the shield metal of the metal supporting means is connected with the synchronous cable and grounded so as to draw out an induced voltage of the FBT.

DETAILED DESCRIPTION OF THE INVENTION

Hereinafter, a preferred embodiment of the present invention will be described more in detail with reference to the accompanying drawings.

Figure 1:
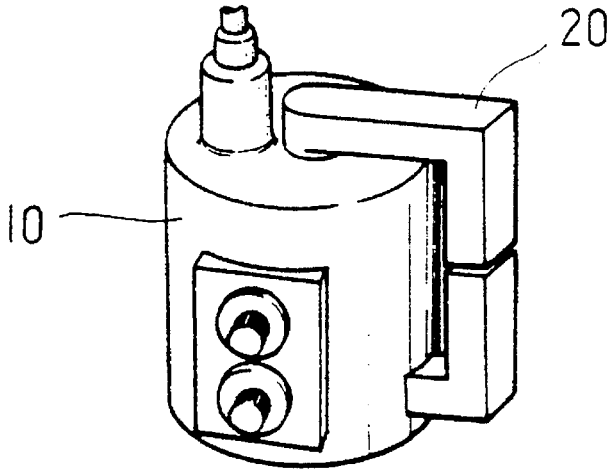
FIG. 1 shows a structure of a general fly back transformer.
Figure 2:
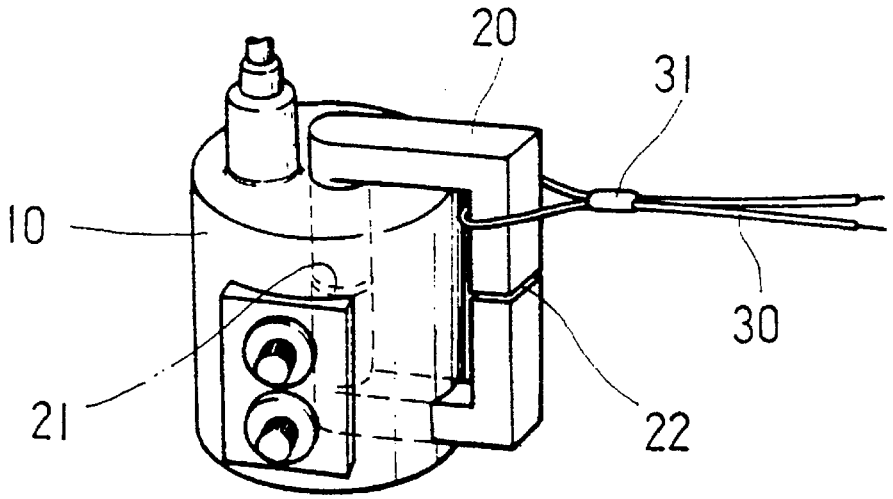
FIG. 2 PRIOR ART
FIG. 2 is a view showing a connecting method of a synchronous cable to a conventional fly back transformer.
Figure 3:
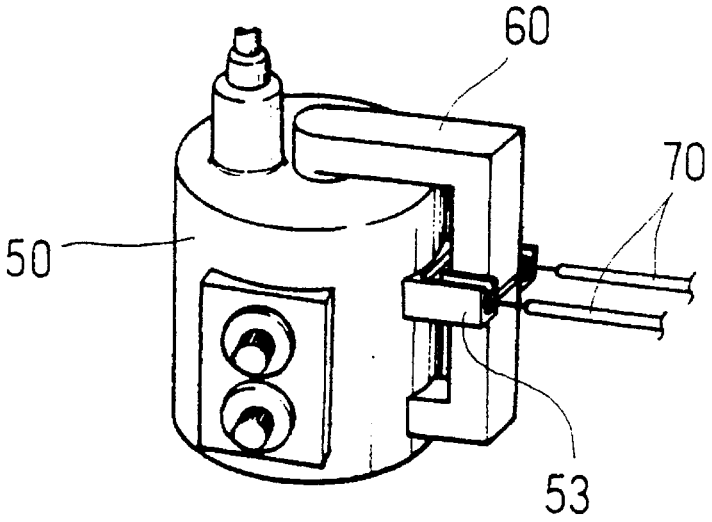
FIG. 3 is a schematic view of a FBT provided with a synchronous cable coupling device of a fly back transformer (FBT) in accordance with the present invention.
Figure 4:
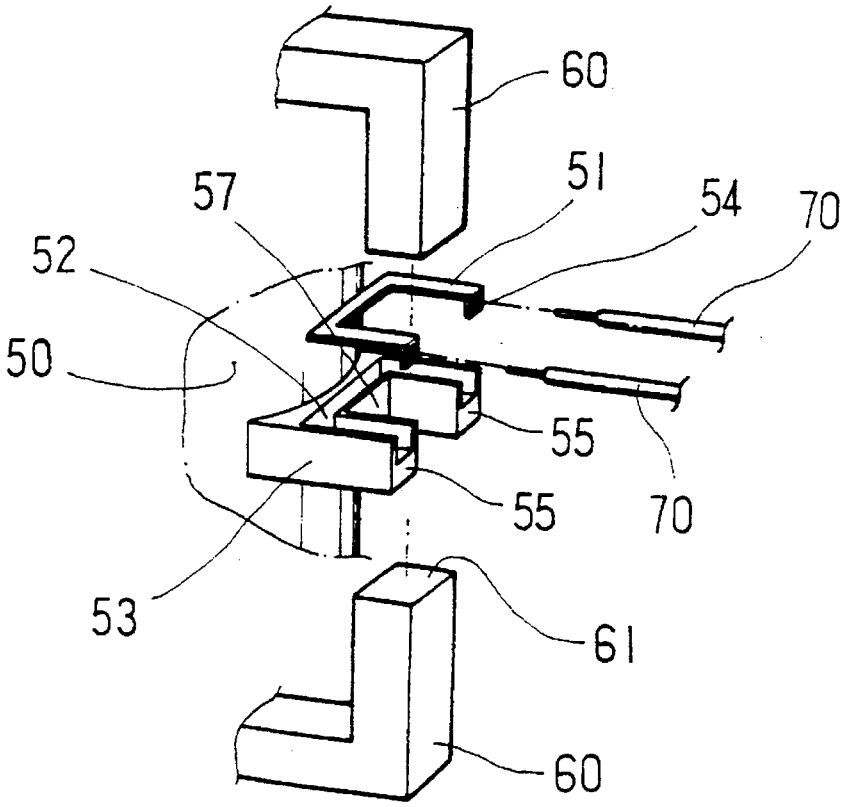
FIG. 4 is an exploded perspective view of the synchronous cable coupling device of the fly back transformer (FET) of the present invention.
Figure 5:
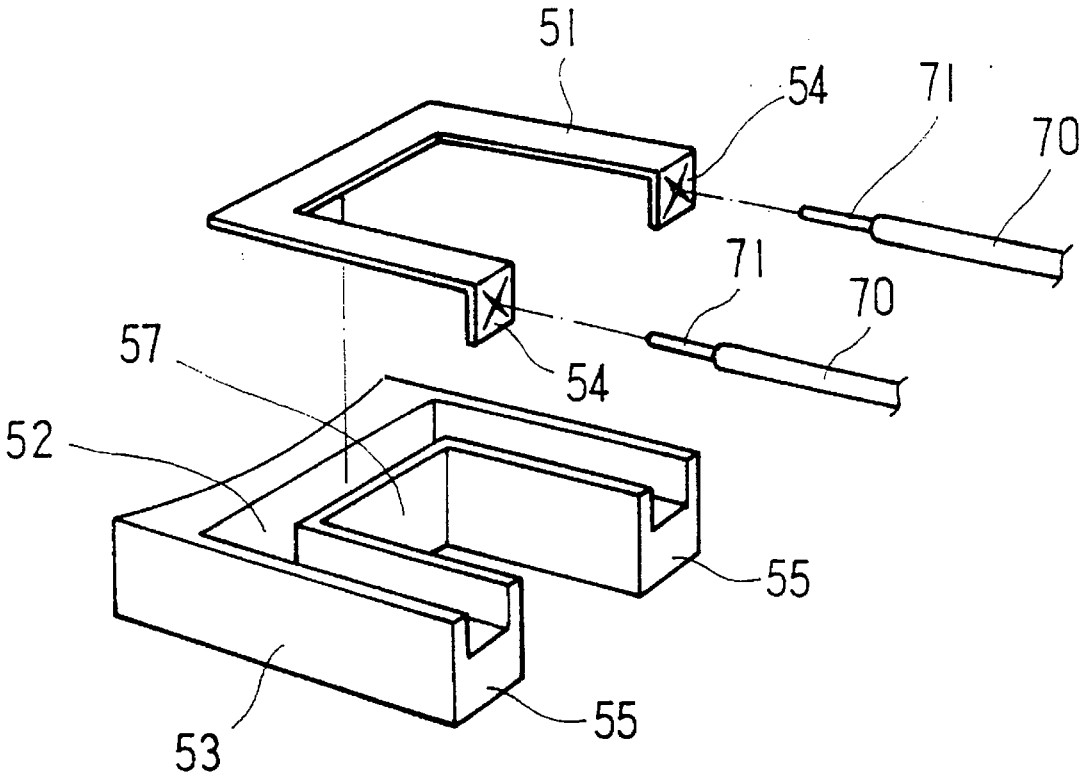
FIG. 5 shows a structure showing a coupling state of the synchronous cable and a shield metal accommodated to the metal supporting means of the present invention.
Figure 6:
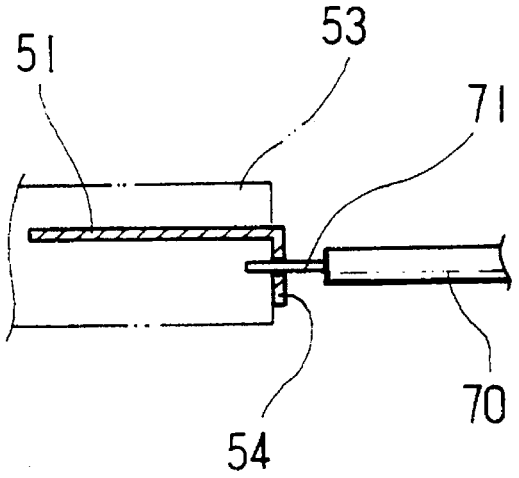
FIG. 6 is a cross sectional view of a coupling state of the synchronous cable and the shield metal of the present invention.

FIG. 3 is a schematic perspective view of a FBT provided with the synchronous cable coupling device of a FBT in accordance with the present invention, FIG. 4 is an exploded perspective view of an essential part of the synchronous cable coupling device of the FBT of the present invention, and FIG. 5 shows a structure of an essential part showing a coupling slate of the synchronous cable and the shield metal accommodated to the metal supporting means of the present invention. In accordance with the synchronous cable coupling device of the FBT of the present invention, an epoxy resin being an insulation resin is filled and molded between the high voltage and low voltage bobbins and the FBT case 50 in a state that the high voltage and low voltage bobbins (not shown) wound with coils to the interior of the FBT case 50 are accommodated therein. A "C"-shaped ferrite core 60 is inserted and fixed while maintaining a predetermined gap between the top and bottom of the FBT case 50.

A metal supporting means 53 is integrally formed with an accommodating groove 52 so as to be interposed with a shield metal 51 to a front wall surface of case 50 of the FBT. The FBT is provided with a ferrite core 60. Ferrite core 60 is inserted and supported between the metal supporting means 53. Shield metal 51 of the metal supporting means 53 is connected with a synchronous cable 70 and grounded so as to draw out an induced voltage of the FBT.

The metal supporting means 53 provided to a front wall surface of the FBT case 50 is formed with an injected material being the same as the FBT case Accommodating groove 52 is formed to the inside of "C" shaped metal supporting means 53. Step 55 is provided to a front wall surface of the metal supporting means 53 so that a grounding piece 54 of the shield metal 51 formed therein is projected outwardly.

And, the shield metal 51 being a conductor to be accommodated to the metal supporting means 53 is made to be "C"-shaped. Grounding piece 54 bent to both sides is formed with an X-shaped cut out portion 56, and a lead wire 71 of the synchronous cable 70 connected thereto is resiliently coupled so as not to be drawn out therefrom.

Metal supporting means 53 is projected at an external gap 61 which is utilized as a coupling portion for the top and bottom ferrite core 60 of FBT case 50. External gap 61 is formed between the core piercing through groove 57 of the metal supporting means 53 so as to absorb an electronic save.

The operation and effect of the present invention made with the above structure is described as follows.

As shown in FIG. 3 to FIG. 6, an epoxy resin being an insulation resin is filled so as to be molded between the high voltage and low voltage bobbins and the FBT case in a state that the high voltage and low voltage bobbins (not shown) wound with coils are contained therein so as to be superposed one another to the interior of the FBT case 50. A high voltage is induced while maintaining an insulation state and the voltage is made to be supplied to the interior of a set such as a monitor and the like. "C"-shaped ferrite core 60 is inserted and fixed while maintaining a predetermined gap between the top and bottom portions of the FBT case 50, so that a noise of an electronic wave generated upon inducement of the high voltage can be eliminated.

And, the metal supporting means 53 recessed with the accommodating groove 52 so as to be interposed or inserted with the shield metal 51 is integrally provided to the front wall surface of the case 50 of the FBT provided with the ferrite core 60 therein. The synchronous cable 70 is connected and grounded to the forward part of the shield metal 51 accommodated or secured to the metal supporting means 53. Ferrite core 60 is closely pierced and supported to the metal supporting means 53 so as to draw out the induced voltage of the FBT.

The metal supporting means 53 provided to the front wall surface of the FBT case 50, as shown in FIG. 4 and FIG. 5, is made from the same injected material as the FBT case 50. Step 55 is formed to a front wall surface of the accommodating groove 52 recessed in the internal side of "C"-shaped metal supporting means 53 so that the grounding piece 54 of the shield metal 51 accommodated thereto is outwardly projected.

In addition to this, the shield metal 51 being a conductor accommodated or connected to the metal supporting means 53 is easily inserted into accommodating groove 52 of the metal supporting means 53 via its "C"-shape. The front of the shield metal 51 includes grounded piece 54 bent and projected to the front and external side of the metal supporting means 53. Grounding piece 54 is provided with an X-shaped cut out portion 56 and the lead wire 71 of the synchronous cable 70 connected thereto is resiliently coupled and can be firmly fixed without being easily drawn out or removed therefrom.

Subsequently, the metal supporting means 53 is provided at the external gap 61 portion coupling the top and bottom ferrite cores 60 of the FBT case 50. The external gap 61 of the top and bottom ferrite cores 60 is formed between the core and inserted in groove 57 of the metal supporting means 53, so that a radiation of electronic wave inevitably generated from the external gap 61 upon drawing out the high voltage is reduced or eliminated. Simultaneously, the electronic wave is effectively absorbed by the synchronous cable 70 provided thereto, and thereby a generation of noise can be effectively isolated.

Thus, in accordance with the synchronous cable of the FBT according to the present invention, there is the excellent result that not only a frequency of the induced voltage generated from the FBT is made to be stably drawn out, but also the coupling of the synchronous cable is automated whereby a workability and a productivity are improved. The synchronous cable is coupled and fixed in a firm state, and according to this method, a movement of the synchronous cable is prevented, a frequency of the synchronous signal of a set and an operating frequency of FBT can be further effectively stabilized, the movement of the FBT ferrite core is prevented upon coupling the synchronous cable, and simultaneously, a radiation or fluctuation of an electronic wave generated from the external gap of the ferrite core can be effectively reduced through the synchronous cable.

Although the present invention is shown and described in relation to a particular embodiment, it should be noted that those skilled in the art can easily know that the present invention can be variously changed and modified and still be within the spirit or scope of the present invention.

What is claimed is:

1. In a fly back transformer (PBT) in which an epoxy resin being an insulation resin is filled and molded between a high voltage bobbin and a low voltage bobbin, a FBT case 50 houses the high voltage and low voltage bobbins wound with coils, and a "C"-shaped ferrite core 60 is inserted and fixed to top and bottom portions of the FBT case 50 while maintaining a predetermined gap, a synchronous cable coupling device of the FBT comprising:

metal supporting means 53 extending to a wall surface of said FBT case and formed with a groove 52;

a shield metal 51 disposed in the groove of said metal supporting means, wherein the ferrite core 60 is inserted in and supported by said metal supporting means 53; and a synchronous cable 70 connected to and grounded by said shield metal and provided so as to transmit an induced voltage of the FBT.

2. In a FBT, the synchronous cable coupling device as defined in claim 1, wherein said metal supporting means 53 is provided to a front wall surface of the FBT case 50 and is formed by a same injected material as the FBT case 50, and wherein the groove 52 is formed to an internal side of the metal supporting means 53.

3. In a FBT, the synchronous cable coupling device as defined in claim 1, further comprising a step 55 provided to a front wall surface of said metal supporting means 53; and a grounding piece 54 provided to the shield metal 51.

4. In a FBT, the synchronous cable coupling device as defined in claim 1, wherein said shield metal includes a grounding piece 54 formed at a forward of the shield metal 51, and said shield metal being a conductor accommodated to the metal supporting means 53.

5. In a FBT, the synchronous cable coupling device as defined in claim 4, wherein said grounding piece 54 is made such that an X-shaped cut out portion 56 is defined therein, and a lead wire 71 of the synchronous cable 70 is resiliently and firmly coupled thereto.

6. In a FBT, the synchronous cable coupling device as defined in claim 1, wherein said metal supporting means 53 is projected at an external gap 61 portion formed between a coupling of top and bottom sections of the ferrite core 60 of the FBT case 50, and between the ferrite core piercing through a second groove 57 of the metal supporting means 53 so as to absorb an electronic wave.

7. In a fly back transformer (FBT) providing an induced voltage and including a FBT case housing high and low voltage bobbins wound with coils with an insulative resin disposed therebetween, and a "C"-shaped ferrite core fixed to the FBT case with a predetermined gap, a cable coupling device of the FBT comprising:

a conductive support extending to a wall surface of said FBT case, formed with a groove, and supporting the ferrite core;

a conductive shield disposed in the groove of said conductive support; and a cable connected to and grounded by said conductive shield and transmitting the induced voltage of the FBT.

* * * * *